US007768206B2

(12) United States Patent
Lee

(10) Patent No.: US 7,768,206 B2
(45) Date of Patent: Aug. 3, 2010

(54) PLASMA DISPLAY PANEL

(75) Inventor: In Young Lee, Seongbuk-gu (KR)

(73) Assignee: LG Electronics Inc., Seoul (KR)

( * ) Notice: Subject to any disclaimer, the term of this patent is extended or adjusted under 35 U.S.C. 154(b) by 907 days.

(21) Appl. No.: 11/556,309

(22) Filed: Nov. 3, 2006

(65) Prior Publication Data

US 2007/0126361 A1 Jun. 7, 2007

(30) Foreign Application Priority Data

Nov. 3, 2005 (KR) ..... 10-2005-0104987

(51) Int. Cl.
*H01J 17/49* (2006.01)

(52) U.S. Cl. ..... 313/587; 313/586; 313/584

(58) Field of Classification Search ..... 313/582–587; 315/169.4; 345/37, 41, 60
See application file for complete search history.

(56) References Cited

U.S. PATENT DOCUMENTS

2002/0047816 A1* 4/2002 Kajiyama et al. ..... 345/41
2002/0121861 A1* 9/2002 Katou et al. ..... 313/587
2004/0075388 A1 4/2004 Miyashita
2004/0130267 A1 7/2004 Kajiyama
2005/0248511 A1* 11/2005 Sakata et al. ..... 345/67

FOREIGN PATENT DOCUMENTS

| | | |
|---|---|---|
| EP | 1 237 175 | 9/2002 |
| EP | 1 298 694 | 4/2003 |
| JP | 08-287833 | 11/1996 |

OTHER PUBLICATIONS

European Search Report dated Oct. 21, 2009 for Application No. 06291697.8, 6 pages.

* cited by examiner

*Primary Examiner*—Nimeshkumar D Patel
*Assistant Examiner*—Christopher M Raabe
(74) *Attorney, Agent, or Firm*—Fish & Richardson P.C.

(57) ABSTRACT

Disclosed is a plasma display panel with improved discharge characteristics. The plasma display panel comprises an upper panel and a lower panel integrally joined to the upper panel through barrier ribs wherein the upper panel includes a dielectric layer, a first protective film formed on one surface of the dielectric layer and composed of columnar magnesium oxide crystal particles, and a second protective film formed on the first protective film and composed of hexahedral magnesium oxide crystal particles.

15 Claims, 3 Drawing Sheets

PLASMA DISPLAY PANEL

This application claims the benefit of Korean Patent Application No. 10-2005-0104987, filed on Nov. 3, 2005 which is hereby incorporated by reference as if fully set forth herein.

BACKGROUND OF THE INVENTION

1. Field of the Invention

The present invention relates to a plasma display panel, and more particularly, to a protective layer of a plasma display panel.

2. Discussion of the Related Art

Plasma display panels comprise an upper panel, a lower panel, and barrier ribs formed between the upper and lower panels to define discharge cells. A major discharge gas, such as neon, helium or a mixed gas thereof, and an inert gas containing a small amount of xenon (Xe) are filled within the discharge cells. When a high-frequency voltage is applied to produce a discharge in the discharge cells, vacuum ultraviolet rays are generated from the inert gas to cause phosphors present between the barrier ribs to emit light, and as a result, images are created. Such plasma display panels have attracted more and more attention as next-generation display devices due to their small thickness and light weight.

FIG. 1 is a perspective view schematically showing the structure of a plasma display panel. As shown in FIG. 1, the plasma display panel comprises an upper panel 100 and a lower panel 110 integrally joined in parallel to and at a certain distance apart from the upper panel. The upper panel 100 includes an upper glass plate 101 as a display plane on which images are displayed and a plurality of sustain electrode pairs, each of which consists of a scan electrode 102 and a sustain electrode 103, arranged on the upper glass plate 101. The lower panel 110 includes a lower glass plate 111 and a plurality of address electrodes 113 arranged on the lower glass plate 111 so as to cross the plurality of sustain electrode pairs.

Stripe type (or well type, etc.) barrier ribs 112 for forming a plurality of discharge spaces, i.e. discharge cells, are arranged parallel to each other on the lower panel 110. A plurality of address electrodes 113, which act to perform an address discharge, are disposed in parallel with respect to the barrier ribs to generate vacuum ultraviolet rays. Red (R), green (G) and blue (B) phosphors 114 are applied to upper sides of the lower panel 110 to emit visible rays upon address discharge, and as a result, images are displayed. A lower dielectric layer 115 is formed between the address electrodes 113 and the phosphors 114 to protect the address electrodes 113.

An upper dielectric layer 104 is formed on the sustain electrode pairs 103, and a protective layer 105 is formed on the upper dielectric layer 104. The upper dielectric layer 104, which is included in the upper panel 100, is worn out due to the bombardment of positive (+) ions upon discharge of the plasma display panel. At this time, short circuiting of the electrodes may be caused by metal elements, such as sodium (Na). Thus, a magnesium oxide (MgO) thin film as the protective layer 105 is formed by coating to protect the upper dielectric layer 104. Magnesium oxide sufficiently withstands the bombardment of positive (+) ions and has a high secondary electron emission coefficient, thus achieving a low firing voltage.

However, the protective layer of the conventional plasma display panel has the following problems.

Firstly, since the magnesium oxide crystal particles constituting the protective layer have a non-uniform diameter, the density of the protective layer is lowered and the crystal is not sufficiently grown.

Secondly, since the magnesium oxide crystal particles constituting the protective layer have a non-uniform size, impurities, e.g., moisture and impurity gases, are attached to the surface of the protective layer. These impurities impede the discharge of the plasma display panel, and cause low contrast and high firing voltage of the plasma display panel, making the circuit structure complicated. This complicated circuit structure may incur considerable costs. Furthermore, the deterioration of the characteristics of the protective layer is intimately associated with the deterioration of jitter characteristics.

SUMMARY OF THE INVENTION

Accordingly, the present invention is directed to a plasma display panel that substantially obviates one or more problems due to limitations and disadvantages of the related art.

An object of the present invention is to provide a protective layer of a plasma display panel wherein the protective layer is composed of magnesium oxide crystal particles having a uniform size.

Another object of the present invention is to provide a protective layer that lowers the firing voltage of a plasma display panel comprising the protective layer and that improves the contrast and jitter characteristics of the plasma display panel.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a plasma display panel comprises an upper panel and a lower panel integrally joined to the upper panel through barrier ribs wherein the upper panel includes a dielectric layer, a first protective film formed on one surface of the dielectric layer and composed of columnar magnesium oxide crystal particles, and a second protective film formed on the first protective film and composed of hexahedral magnesium oxide crystal particles.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The present invention provides a plasma display panel comprising a bilayered protective layer. Hereinafter, a layer formed on one surface of an upper dielectric layer is referred to as a 'first protective film', and a layer formed on the first protective film is referred to as a 'second protective film'. The first protective film is composed of densely-packed columnar magnesium oxide crystal particles and acts to protect the dielectric layer. The second protective film is composed of hexahedral magnesium oxide crystal particles spaced apart from each other at intervals, making the entire surface of the protective layer irregular. The irregular surface of the protective layer can contribute to an increase in the firing voltage of the plasma display panel.

Figure 1:
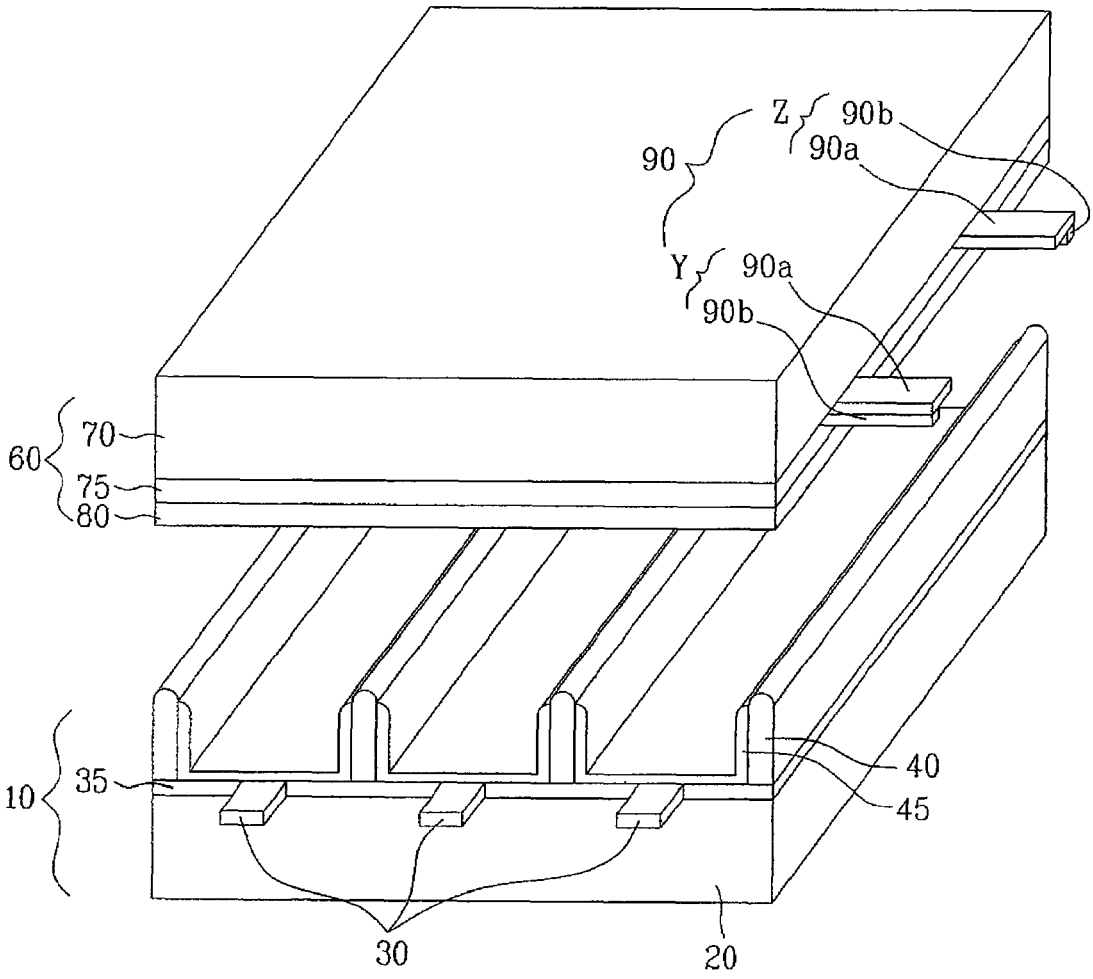
FIG. 1 is a perspective view of a conventional plasma display panel.
Figure 2:
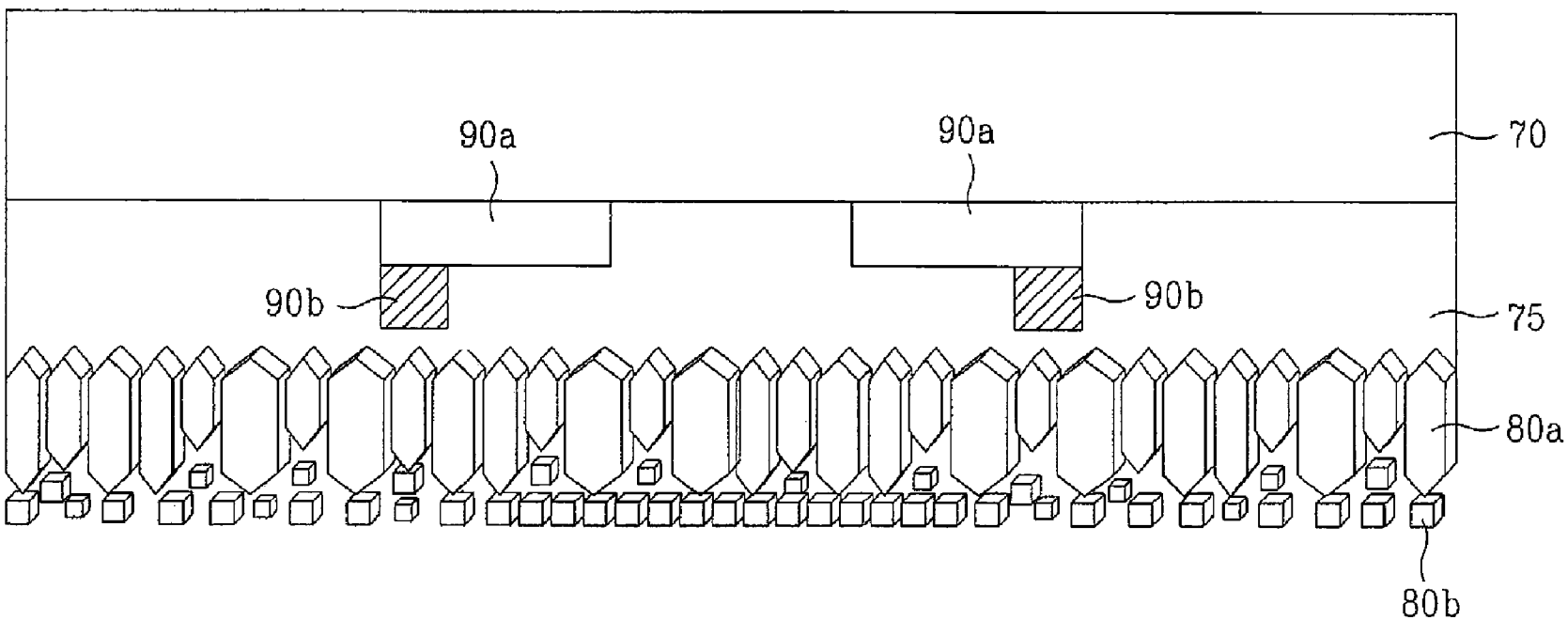
FIG. 2 is a cross-sectional view of an upper panel of a plasma display panel according to an embodiment of the present invention.

FIG. 2 is a cross-sectional view of an upper panel of a plasma display panel according to an embodiment of the present invention.

The upper panel of the plasma display panel according to this embodiment of the present invention comprises sustain electrode pairs 90*a* and 90*b*, an upper dielectric layer 75, and a first protective film 80*a* and a second protective film 80*b* sequentially formed on an upper glass plate 70. The upper glass plate 80 is made of soda-lime glass or PD 200. Each of the sustain electrode pairs consists of a scan electrode and a sustain electrode. Each of the scan electrode and the sustain electrode is made by forming a bus electrode 90*b* on a transparent electrode 90*a* made of indium-tin-oxide (ITO). The upper dielectric layer 75 is formed on the sustain electrode pairs to protect the sustain electrode pairs. The first protective film 80*a* and the second protective film 80*b* are sequentially formed on the upper dielectric layer 75.

The first protective film 80*a* is preferably composed of columnar magnesium oxide crystal particles. As shown in FIG. 2, the columnar crystal particles are formed in a direction perpendicular to the upper dielectric layer 75. The columnar crystal particles may be inclined at an angle with respect to the upper dielectric layer 75. The columnar crystal particles may have a hexagonal, tetragonal or pentagonal cross section so long as their height is greater than their width. The magnesium oxide crystal particles constituting the first protective film 80*a* are densely packed sufficiently to protect the upper dielectric layer 75 from the bombardment of positive (+) ions. The first protective film 80*a* preferably has a thickness of 300 to 750 nm. When the first protective film 80*a* has a thickness of less than 300 nm, the upper dielectric layer 75 may be insufficiently protected against the bombardment of positive (+) ions. In terms of reduction in production costs and simplicity of production procedure, the thickness of the first protective film 80*a* is preferably limited to 750 nm or less. On the other hand, when the first protective film 80*a* has a thickness larger than 750 nm, the magnesium oxide crystal particles present on the surface of the protective layer may be sputtered and adsorbed to other surfaces with increasing time of use of the plasma display panel.

The columnar magnesium oxide crystal particles constituting the first protective film 80*a* have a width of 250 to 500 nm. If the longitudinal cross section of the columnar crystal is a polygon, the size of the columnar crystal means a length of one side of the polygon. If the longitudinal cross section of the columnar crystal is a circle, the size of the columnar crystal means the diagonal length of the circle. The magnesium oxide crystal constituting the first protective film 80*a* preferably has a (111) orientation. As shown in FIG. 2, the columnar crystal particles are densely packed in the first protective film 80*a* to protect the upper dielectric layer 75 against the bombardment of positive (+) ions within discharge cells.

The second protective film 80*b* formed on the first protective film 80*a* is composed of hexahedral magnesium oxide crystal particles. As shown in FIG. 2, the hexahedral magnesium oxide crystal particles are spaced apart from each other at intervals in the second protective film 80*b*. Due to this structure of the second protective film 80*b*, the entire surface of the protective layer formed on the upper glass plate of the plasma display panel has an irregular shape. The shape of the hexahedral crystal is most preferably a cube. Taking into consideration various factors, such as errors, during formation of the crystal, the ratio of the length of the longest edge to the length of the shortest edge is preferably 1:1 to 2:1. The hexahedral crystal particles preferably have a size of 50 to 200 nm. The size of the hexahedral crystal particles has the same meaning as described above. In addition, the magnesium oxide crystal constituting the second protective film 80*b* has a (200) orientation.

The second protective film 80*b* may contain magnesium oxide crystal particles having a (111) orientation. At this time, the number of the magnesium oxide crystal particles having a (111) orientation must be smaller than that of the magnesium oxide crystal particles having a (200) orientation. Specifically, the density ratio between the magnesium oxide crystal particles having a (111) orientation and the magnesium oxide crystal particles having a (200) orientation may be between 1:5 and 1:10.

Since the magnesium oxide crystal constituting the first protective film 80*a* is prepared by sputtering, it is formed in a columnar shape on the upper dielectric layer 75. Meanwhile, since the magnesium oxide crystal constituting the second protective film 80*b* is pulverized and re-formed on the first protective film 80*a*, it has a crystal shape.

The magnesium oxide crystal particles constituting the first protective film 80*a* formed on the second protective film 80*b* preferably have a non-uniform density in terms of improvement in discharge efficiency. Specifically, the magnesium oxide crystal particles constituting the second protective film 80*b* are present at a higher density within discharge spaces than within non-discharge spaces. The non-discharge spaces are spaces where no discharge occurs during driving of the plasma display panel, and refer to upper portions of the barrier ribs defining the discharge cells. That is, since the collision frequency of a plasma gas within the discharge spaces increases during discharge, it is preferred that the magnesium oxide crystal particles have a high density within the discharge spaces. Further, it is preferred that the magnesium oxide crystal particles be present at a higher density at the central portion of the discharge spaces than at the peripheral portion of the discharge spaces. This is because positive (+) charges more frequently collide with the protective layer at the central portion of the discharge spaces than at the peripheral portion of the discharge spaces during discharge.

A dopant may be added to the protective layer to lower the porosity and increase the density of the protective layer. As a result, attachment of impurities to the surface of the MgO thin film is prevented to lower the firing voltage of the plasma display panel. The dopant acts to decrease the porosity and increase the density to prevent attachment of impurities on the surface of the magnesium oxide thin film and to lower the firing voltage of the plasma display panel. Silicon or lead can be added as the dopant. Other examples of the dopant include aluminum (Al), boron (B), barium (Ba), indium (In), zinc (Zn), phosphorus (P), gallium (Ga), germanium (Ge), scandium (Sc), and yttrium (Y). The dopant may be formed on the first protective film and/or the second protective film. The dopant is preferably used at a concentration not higher than 500 ppm (parts per million). It is preferred that an oxide powder of the dopant be homogeneously mixed with the magnesium oxide crystal particles within the protective layer. Examples of suitable oxides include $Al_2O_3$, $B_2O_3$, $SiO_2$, $P_2O_5$, $Ga_2O_3$, $GeO_2$, $Sc_2O_3$, and $Y_2O_3$.

Figure 3:
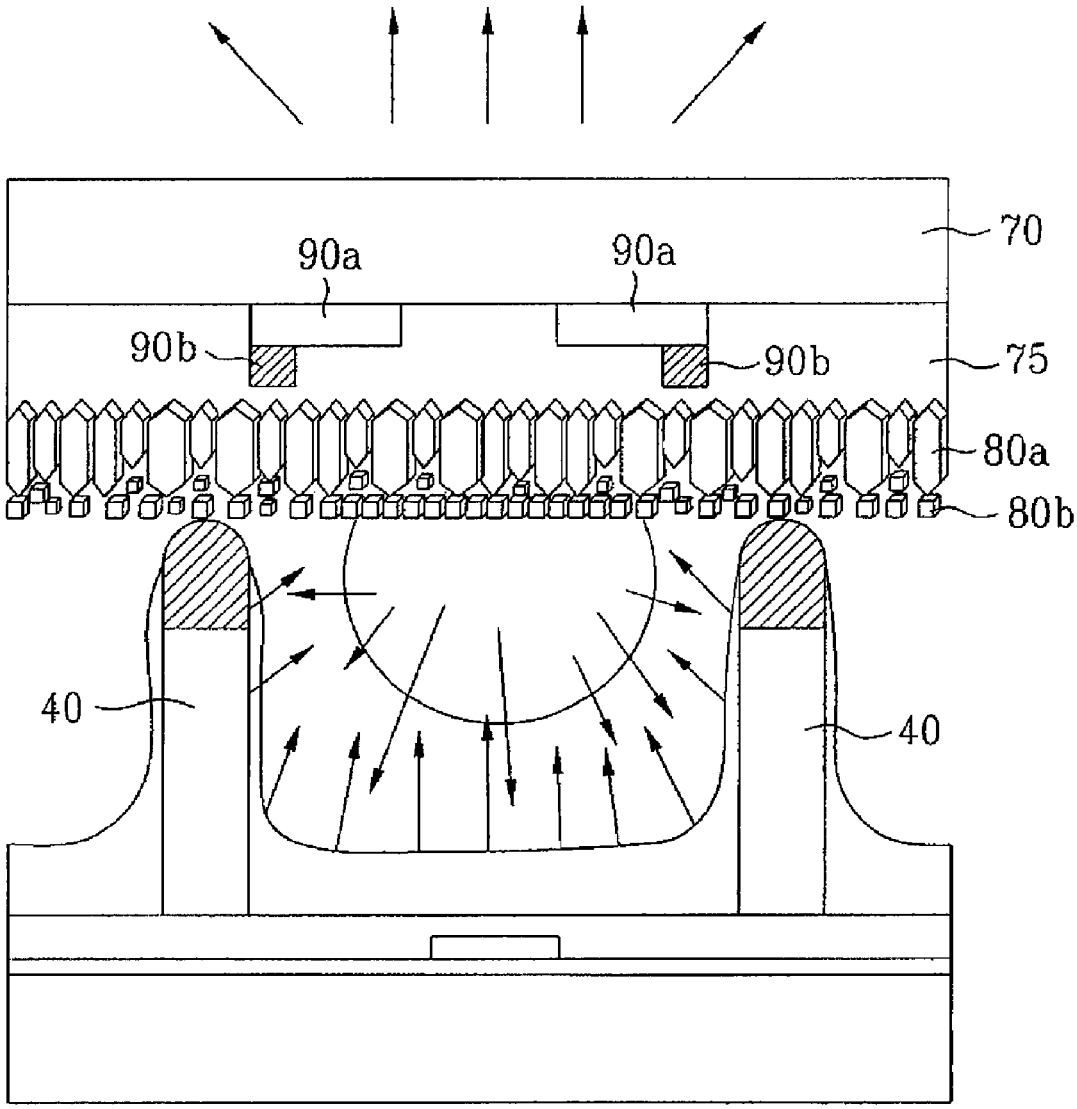
FIG. 3 is a cross-sectional view showing the structure of discharge cells of a plasma display panel according to an embodiment of the present invention.

FIG. 3 is a cross-sectional view showing the structure of discharge cells of a plasma display panel according to an embodiment of the present invention. With reference to FIG. 3, an explanation of the discharge cells of the plasma display panel according to this embodiment of the present invention will be provided below.

The discharge spaces are defined by an upper panel, a lower panel and barrier ribs 40. The discharge spaces are in contact with a second protective film 80*b*, which is in contact with an upper dielectric layer 75 through the first protective film 80*a*. Both first and second protective films 80*a* and 80*b* are composed in the form of thin films using magnesium oxide (MgO). The first and second protective films 80*a* and 80*b* serve to protect the upper dielectric layer upon discharge to guarantee the service life of the plasma display panel. When plasma ions are incident on the first and second protective films 80*a* and 80*b*, secondary electrons are emitted from the surfaces of the first and second protective films 80*a* and 80*b*. This emission of secondary electrons may allow the discharge to be produced at a lower voltage. The first protective film 80*a* is composed of magnesium oxide particles having a uniform diameter, a low porosity and a high density so that it can protect the upper dielectric layer against the bombardment of charges. The second protective film 80*a* can prevent attachment of impurity gases to the surface to lower the firing voltage of the plasma display panel.

Since the collision frequency of a plasma gas within the discharge spaces increases even in the second protective film 80*b*, the magnesium oxide crystal particles present are present at a higher density within the discharge spaces, i.e. between sustain electrode pairs, than outside the discharge spaces, i.e. upper portions of the barrier ribs. Further, since the collision frequency of a plasma gas at the central portion of the discharge spaces increases, it is preferred that the magnesium oxide crystal particles constituting the second protective film 80*a* be present at a higher density at the central portion of the discharge spaces than at the peripheral portion of the discharge spaces.

When a driving voltage is applied to the plasma display panel comprising the discharge cells, the magnesium oxide particles constituting the protective layer are sublimed with high energy. As the shape of the magnesium oxide crystal becomes closer to a cube, the binding energy of the magnesium oxide particles is increased. As a result, the growth of the crystal is promoted, so that attachment of impurities (e.g., moisture and impurity gases) to the surface of the protective layer is prevented and obstacles to the discharge of the plasma display panel are reduced, resulting in a decrease in firing voltage, an improvement in jitter characteristics and an increase in contrast.

The methods for producing the plasma display panels according to the embodiments of the present invention are the same as conventional production methods, except that the electrodes are formed in different manners.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A plasma display panel comprising:

an upper panel; and a lower panel integrally joined to the upper panel through barrier ribs, wherein the upper panel includes:

a dielectric layer, a first protective film formed on one surface of the dielectric layer and composed of columnar magnesium oxide crystal particles, and a second protective film formed on the first protective film and composed of hexahedral magnesium oxide crystal particles, and wherein the magnesium oxide crystal particles constituting the second protective film are present at a higher density within discharge spaces than within non-discharge spaces.

2. The plasma display panel according to claim 1, wherein the hexahedral magnesium oxide crystal particles have a ratio of the length of the longest edge to the length of the shortest edge of 1:1 to 2:1.

3. The plasma display panel according to claim 1, wherein the magnesium oxide crystal constituting the second protective film has a cubic shape.

4. The plasma display panel according to claim 1, wherein the second protective film has a thickness of 50 to 200 nm.

5. The plasma display panel according to claim 1, wherein the first protective film has a thickness of 300 to 750 nm.

6. The plasma display panel according to claim 3, wherein the cubic crystal has an edge length of 50 to 200 nm.

7. The plasma display panel according to claim 1, wherein the columnar magnesium oxide crystal particles have a width of 250 to 500 nm.

8. The plasma display panel according to claim 1, wherein the magnesium oxide crystal constituting the first protective film has a (111) orientation.

9. The plasma display panel according to claim 1, wherein the magnesium oxide crystal constituting the second protective film has a (200) orientation.

10. The plasma display panel according to claim 1, wherein the non-discharge spaces are formed at upper portions of barrier ribs.

11. The plasma display panel according to claim 1, wherein the magnesium oxide crystal particles constituting the second protective film are present at a higher density at the central portion of the discharge spaces than at the peripheral portion of the discharge spaces.

12. The plasma display panel according to claim 1, wherein the first protective film contains at least one element selected from aluminum (Al), boron (B), barium (Ba), indium (In), silicon (Si), lead (Pb), zinc (Zn), phosphorus (P), gallium (Ga), germanium (Ge), scandium (Sc), and yttrium (Y).

13. The plasma display panel according to claim 1, wherein the second protective film contains at least one element selected from aluminum (Al), boron (B), barium (Ba), indium (In), silicon (Si), lead (Pb), zinc (Zn), phosphorus (P), gallium (Ga), germanium (Ge), scandium (Sc), and yttrium (Y).

14. A plasma display panel comprising:

an upper panel; and a lower panel integrally joined to the upper panel through barrier ribs, wherein the upper panel includes:

a dielectric layer, a first protective film formed on one surface of the dielectric layer and comprised of columnar magnesium oxide crystal particles, and a second protective film formed on the first protective film and comprised of hexahedral magnesium oxide crystal particles, and wherein the magnesium oxide crystal particles comprising the second protective film are present at a higher density within discharge spaces than within non-discharge spaces.

15. A method of manufacturing a plasma display panel comprising:

integrally joining a lower panel to an upper panel through barrier ribs;

means for forming on one surface of a dielectric layer included in the upper panel a first protective film comprised of columnar magnesium oxide crystal particles; and means for forming on the first protective layer a second protective layer comprised of hexahedral magnesium oxide crystal particles, wherein the magnesium oxide crystal particles comprising the second protective film are present at a higher density within discharge spaces than within non-discharge spaces.

* * * * *